United States Patent [19]

Kasuya et al.

[11] Patent Number: 4,492,546

[45] Date of Patent: Jan. 8, 1985

[54] ROTOR TOOTH FORM FOR A SCREW ROTOR MACHINE

[75] Inventors: Katsuhiko Kasuya; Hidetomo Mori; Mitsuru Fujiwara; Tetsuzo Matsunaga, all of Ibaraki, Japan

[73] Assignee: Hitachi, Ltd., Tokyo, Japan

[21] Appl. No.: 436,371

[22] Filed: Oct. 25, 1982

[30] Foreign Application Priority Data

Mar. 27, 1981 [JP] Japan ..... 56-43904
Apr. 24, 1981 [JP] Japan ..... 56-61182

[51] Int. Cl.[3] ..... F01C 1/16; F01C 1/24
[52] U.S. Cl. ..... 418/201
[58] Field of Search ..... 418/150, 201

[56] References Cited

U.S. PATENT DOCUMENTS 2,325,617 8/1943 Lysholm ..... 418/201
2,683,994 7/1954 Whitfield ..... 418/201
2,901,164 8/1959 Whitfield ..... 418/201
4,401,420 8/1983 Kasuya ..... 418/201
4,406,602 9/1983 Kasuya ..... 418/201

*Primary Examiner*—Leonard E. Smith
*Assistant Examiner*—Jane E. Obee
*Attorney, Agent, or Firm*—Antonelli, Terry & Wands

[57] ABSTRACT

Rotor tooth forms for a pair of screw rotors in the form of a female rotor and a male rotor, wherein the female rotor has a rotor tooth form including a flank of a surface of advance constituted by an arc and a second order curve, and a flank of a surface of retrocession constituted by a curve generated by an arc of a forward end portion of a lobe on the male rotor and an arc, and the male rotor has a rotor tooth form essentially formed by generating loci of the flank of the surface of advance of the female rotor and the flank of the surface of retrocession thereof.

7 Claims, 14 Drawing Figures

ROTOR TOOTH FORM FOR A SCREW ROTOR MACHINE

BACKGROUND OF THE INVENTION

This invention relates to screw rotors of screw compressors, and more particularly, to rotor tooth forms for a pair of screw rotors suitable for use with a dry type screw compressor, blower, expander, etc., in which the rotors rotate while in meshing engagement with each other by using synchronizing means without being brought into contact with each other.

Generally, in oil less type screw compressors for use in applications where mingling of oil in the gas discharged from a screw compressor is not desirable, transmission of rotation between a pair of screw rotors is effected through synchronizing means mounted at shaft portions outside the working chambers of the rotors, and at this time the rotors rotate while meshing with each other without coming into contact with each other. The screw rotors of this type of screw compressors have a greater chance of the gas leaking from between the rotors and the casing and between the rotors and from the blowholes than the screw rotors of screw compressors of the oil-cooled type in which the oil is injected into the working chambers in which the rotors mesh with each other to effect lubrication and cooling of the rotors and provide a seal to the rotors. As a result, the size of the clearance and the blowholes exert great influences on the efficiency of the compressors. In view of this fact, there has been a demand for a high degree of accuracy and precision with which the rotors are shaped and for a rotor tooth form of small blowholes.

In the screw rotors of this type of screw compressors, the teeth of the rotors have their temperatures raised to a high level during operation, and, consequently, are greatly deformed during operation as compared with the rotor teeth in normal temperature during an inoperative period. Thus, in designing the shape of the two rotors of a screw compressor, it is necessary not only to take into consideration the dimensions of the rotors to provide clearances between the rotors and between the rotors and the casing in such a manner that the rotors are not brought into contact with each other during operation and yet the clearance is minimized, but also to provide means for avoiding the occurrence of seizure between the rotors and the casing.

In designing screw rotors, it has been the usual practice to decide a clearance between the two rotors and a clearance between the rotors and the casing based on a casual idea, and, consequently, the clearances formed have had no theoretical basis. This has given rise to a number of problems with regard to the operation efficiency of the screw compressors that have remained unsolved.

More specifically, as a process for imparting a clearance between the two rotors, proposals have been made to use a male rotor as a reference for providing a basic tooth form of the rotors and a clearance of a predetermined size is provided in the direction normal to the female rotor tooth form by taking into consideration deformation and other factors that might possibly be caused to occur by thermal expansion during operation. The screw rotors produced by this process have already been put to practical use.

However, in view of the fact that deformation of the tooth form due to thermal expansion may vary depending on the shape of the tooth form, the value of the clearance decided by the process described hereinabove would not be considered an optimum value that is obtained by careful analysis of the condition of the rotors expanded by heat and of the condition of the clearance during operation.

In, for example, U.S. Pat. No. 3,414,189, another process for imparting a clearance to the two rotors of a screw compressor is proposed wherein a small clearance is provided in a region in which the relative sliding movement between the two rotor teeth meshing with each other is small and a sufficiently large clearance is provided to other regions of the rotor teeth.

However, the last-mentioned process could not be considered to take the thermal deformation of the two rotors into consideration quantitatively in providing a clearance to between the rotor.

SUMMARY OF THE INVENTION

Object of the Invention

An object of this invention is to provide a pair of screw rotors wherein a minimum clearance can be provided through the entire region of the teeth of the female rotor and the male rotor in meshing engagement with each other during operation to thereby greatly improve performance.

Another object of the invention is to provide a pair of screw rotors wherein the female rotor and the male rotor are constructed by taking into consideration the backlash of the synchronizing gears to avoid seizing due to contact of the two rotors during operation, to thereby improve the reliability of the screw compressor.

Still another object of the invention is to provide a pair of screw rotors capable of greatly improving performance by taking into consideration the axial temperature distribution inside and outside the rotors when they are constructed.

A further object of the invention is to provide a pair of screw rotors capable of greatly prolonging the service life of the tools used for producing the screw rotor and having a reduced area of blowholes.

To accomplish the aforesaid objects, in accordance with the invention, a female rotor, and a male rotor rotating about two axes parallel to each other and forming a pair of screw rotors, are provided with tooth forms wherein a flank of the surface of advance of the female rotor is constituted by a first flank of the surface of advance formed by a second order curve, and a second flank of the surface of advance formed by an arc of an imaginary circle of a radius $R_1$ having a center thereof inside the pitch circle of the female rotor. The flank of the surface of retrocession of the female rotor is constituted by a first flank of the surface of retrocession generated by a forward end portion of a lobe of the male rotor formed by an arc of an imaginary circle of a radius $R_4$ having a center thereof on a line drawn from a pitch point which is inclined through an angle $\phi$ with respect to a straight line connecting the two axes together, and a second flank of the surface of retrocession formed by an arc of an imaginary circle of a radius $R_3$ of an imaginary circle having center thereof inside the pitch circle of the female rotor. The male rotor is essentially formed by generating loci of the flank of the surface of advance of the female rotor and the flank of the surface of retrocession thereof, to thereby provide basic tooth forms of the female rotor and the male rotor.

Another outstanding characteristic of the present invention resides in the fact that that in the tooth forms imparted to a female rotor and a male rotor, the flank of the surface of advance of the female rotor is constituted by a first flank of the surface of advance formed by a second order curve, and a second flank of the surface of advance formed by an arc of an imaginary circle of a radius $R_1$ having a center thereof inside a pitch circle of the female rotor. The flank of the surface of retrocession of the female rotor is constituted by a first flank of the surface of retrocession generated by a forward end portion of a lobe of the male rotor formed by an arc of an imaginary circle of a radius $R_4$ having a center thereof on a line drawn, from the pitch point, which is inclined through an angle $\phi$ with respect to a straight line connecting the two axes together, and a second flank of the surface of retrocession formed by an arc of an imaginary circle of a radius $R_3$ of an imaginary circle having its center inside the pitch circle of the female rotor. The male rotor is essentially formed by generating loci of the flank of the surface of advance of the female rotor and the flank of the surface of retrocession thereof, to thereby provide basic tooth forms of the female rotor and the male rotor.

Still another outstanding characteristic of the present invention resides in the fact that in the tooth forms imparted to a female rotor and a male rotor, the flank of the surface of advance of the female rotor is constituted by a first flank of the surface of advance formed by a second order curve, and a second flank of the surface of advance formed by an arc of an imaginary circle of a radius $R_1$ having its center inside the pitch circle of the female rotor. The flank of the surface of retrocession of the female rotor is constituted by a first flank of the surface of retrocession generated by a forward end portion of a lobe of the male rotor formed by an arc of an imaginary circle of a radius $R_4$ having a center thereof on a line, drawn from the pitch point, which is inclined through an angle $\phi$ with respect to a straight line connecting the two axes together, and a second flank of the surface of retrocession formed by an arc of an imaginary circle of a radius $R_3$ of an imaginary circle having a center thereof inside the pitch circle of the female rotor. The male rotor is essentially formed by generating loci of the flank of the surface of advance of the female rotor and the flank of the surface of retrocession thereof, to thereby provide basic tooth forms of the female and male rotors.

DETAILED DESCRIPTION

Figure 1:
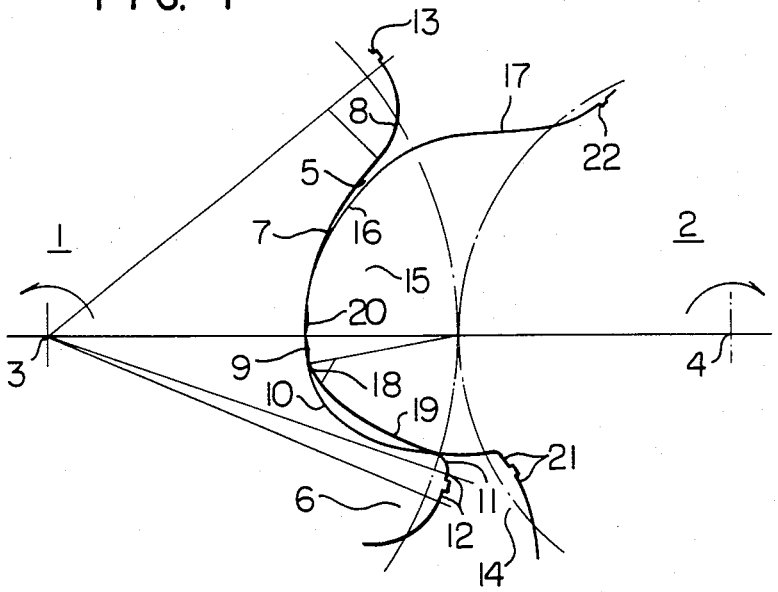
FIG. 1 is an enlarged detailed view perpendicular to an axis of rotation of the rotors of basic tooth forms of screw rotors constructed in accordance with a first embodiment of the present invention.

Referring now to the drawings wherein like reference numerals are used throughout the various views to designate like parts and, more particularly, to FIG. 1, according to this figure, a female rotor 1 and a male rotor 2 are in meshing engagement with each other, with the two rotors 1 and 2 respectively having centers of rotation 3, 4 for rotation in a casing, not shown, in the directions of arrows, so as to function as a compressor. The two rotors 1 and 2 have synchronizing means, not shown, mounted at their respective shafts outside working chambers, to enable the rotors 1, 2 to rotate while a small clearance is being maintained therebetween without the rotors 1, 2 coming into contact with each other.

In normal temperature condition, the female rotor 1 is formed with a plurality of grooves 5 and lobes 6, with the surface of advance of each groove 5 being constituted by a first flank 7 and a second flank 8, while a surface of retrocession of each groove 5 is constituted by a tooth root flank 9, a first flank 10 and a second flank 11. The tooth top of each lobes 6 is constituted by an outer peripheral flank 12 and a tooth top tip 13. Meanwhile, the male rotor 2 is formed with a plurality of grooves 14 and lobes 15, with the surface of advance of each lobe 15 being constituted by a first flank 16 and with a second flank 17, and the surface of retrocession thereof being constituted by a first flank 18 and a second flank 19. The forward end of each lobe 15 is constituted by a tooth top tip 20, and the tooth root of each groove 14 is constituted by a tooth root flank 21 and a recess 22.

Figure 2:
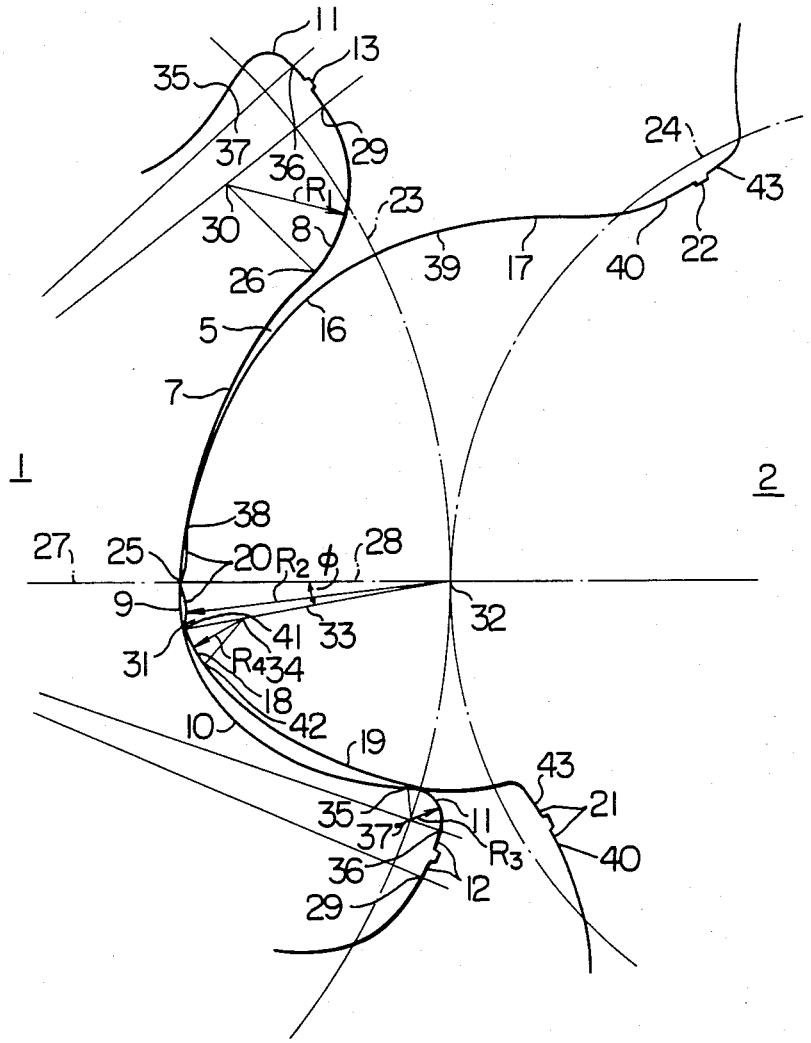
FIG. 2 is an enlarged detail view similar to FIG. 1.

As shown in FIG. 2, in the surface of advance of the female rotor 1, a section 25–26 of the first flank 7 is formed by a parabola, one kind of a second order curve, focused on a point 28 on a straight line connecting the centers 3 and 4 of the two rotors 1 and 2 together. A section 26–29 of the second flank 8 is formed by an arc of an imaginary circle of a radius $R_1$ centered at a point 30 inside a pitch circle 23. In the surface of retrocession of the female rotor 1, a section 25–31 of the tooth root flank 9 is formed by an arc of an imaginary circle of a radius $R_2$ centered at a pitch point 32, and a section 31–35 of the first flank 10 is formed as a locus generated by the first flank 18 of the surface of retrocession of the male rotor 2 formed by an arc of an imaginary circle of a radius $R_4$ centered at a point 34 on a line 33 inclined through an angle $\phi$ with respect to a straight line connecting the centers 3 and 4 of the two rotors 1 and, 2 together. A section 35–36 of the second flank 11 of the surface of retrocession of the female rotor 1 is formed by an arc of an imaginary circle of a radius $R_3$ smaller than the radius $R_1$ of the imaginary circle forming the second flank 8 of the surface of advance and centered at a point 37 inside the pitch circle 23.

By forming the second flank 8 of the surface of advance of the female rotor 1 by the arc of the imaginary circle of the radius $R_1$ which is greater than the radius $R_3$ of the imaginary circle of the arc forming the second flank 11 of the surface of retrocession of the female rotor 1, it is possible to greatly prolong the service life of the cutting blade of a hob for working on the rotors 1, 2 and to use an inexpensive material for producing the cutting blade of the hob with precision finishes. Thus, it is possible to produce the rotors 1, 2 by using a hob with a cutting blade of high precision finishes, so that the precision with which the rotors 1, 2 can be produced is increased and the performance of the compressor can be greatly improved. Since the radius $R_3$ of the imaginary circle of the arc for forming the second flank 11 of the surface of retrocession is small, the blowholes have a small area and leaks of gas are reduced, to thereby improve the performance of the compressor.

By forming the first flank 7 of the surface of a advance by a secondary curve of parabola, it is possible to lower the rate of slipping occurring when the female rotor 1 is driven by the male rotor 2. This is conducive to a reduction in wear caused on the two rotors 1, 2 and a mechanical loss suffered as by bearings of the rotors.

In FIG. 2 again, a section 36–29 of the outer peripheral flank 12 of each lobe 6 of the female rotor 1 is formed by an arc of an imaginary circle having its center at the center 3 except for an elevated portion of the tooth top tip 13.

Meanwhile in the surface of advance of the male rotor 2, a section 38–39 of the first flank 16 is of a shape generated by the first flank 7 of the surface of advance of the female rotor 1, and a section 39–40 of the second flank 17 is of a shape generated by the second flank 8 of the surface of advance of the female rotor 1. A section 41–42 of the first flank 18 of the surface of retrocession is formed by the arc of the imaginary circle of the radius $R_4$ centered at the point 34, and a section 42–43 of the second flank 19 is generated by the second flank 11 of the surface of retrocession of the female rotor 1. A forward end of each lobe 15 is formed by the tooth top tip 20, and a section 40–43 of the tooth root flank 21 is formed by an arc of an imaginary circle having its center at the center point 4 of the male rotor 2 except for the recess 22 which is formed as a groove of a size large enough to receive the tooth top tip 13 of the female rotor 1.

Figure 3:
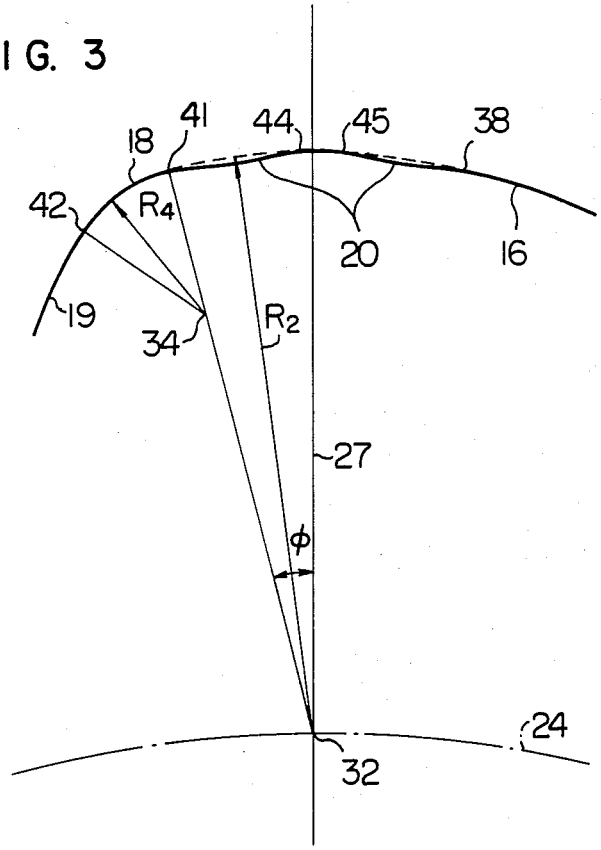
FIG. 3 is an enlarged detail view of a tip of a tooth top of the male rotor.

As shown in FIG. 3, the tooth top tip 20 of the male rotor 2 is formed with a section indicated by a solid line 41–44–45–38, and the shape of the tooth top tip 20 is a tip form that can be generated when the male rotor 2 is produced by hobbing.

By forming at the forward end of the lobe on the female rotor 1 and the male rotor 2 tooth top tips 13, 20 of a shape that can best be produced by hobbing, it is possible to produce screw rotors 1, 2 by relying on hobbing alone for forming all the shapes of the rotors. This is conducive to improved productivity. Moreover, the provision of the tooth top tips 13, 20 enables seizure between the rotors 1, 2 and the casing to be avoided, thereby improving the reliability of compressor.

Figure 4:
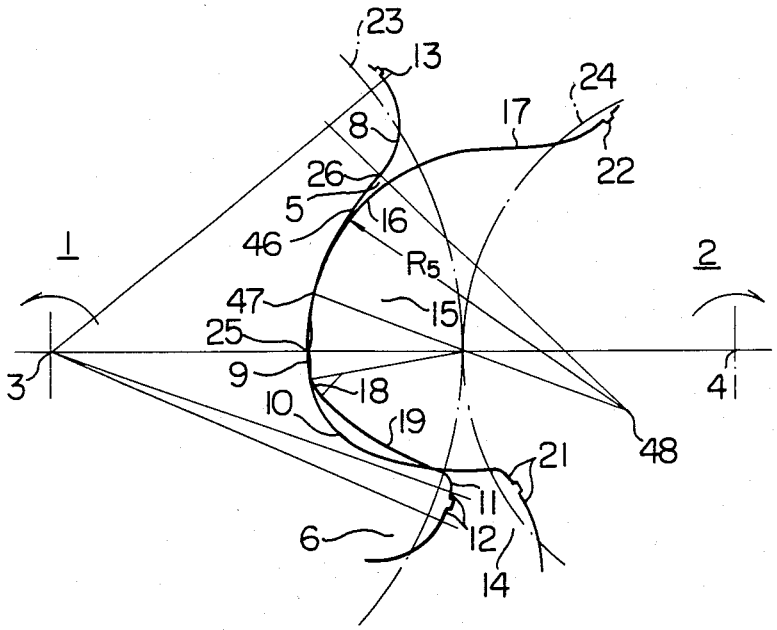
FIG. 4 is an enlarged detailed view perpendicular to an axis of rotation of the screw rotors of the basic tooth forms of screw rotors constructed in accordance with a second embodiment of the present invention.

As shown in FIG. 4, a first flank 46 of the surface of advance of the female rotor is formed by an arc of a second order curve which extends from a point 26 to a point 47, with the section 26–47 being formed by an arc of an imaginary circle of a radius $R_5$ having its center 48 outside the pitch circle 23 of the female rotor 1. A section 25–47 is formed by an arc of an imaginary circle having its center at a point of intersection between the pitch circles 23 and 24.

By forming the first flank 46 of the surface of advance by an arc, it is possible to increase the pressure angle of the cutting blade of a hob, to thereby facilitate hobbing.

Figure 5:
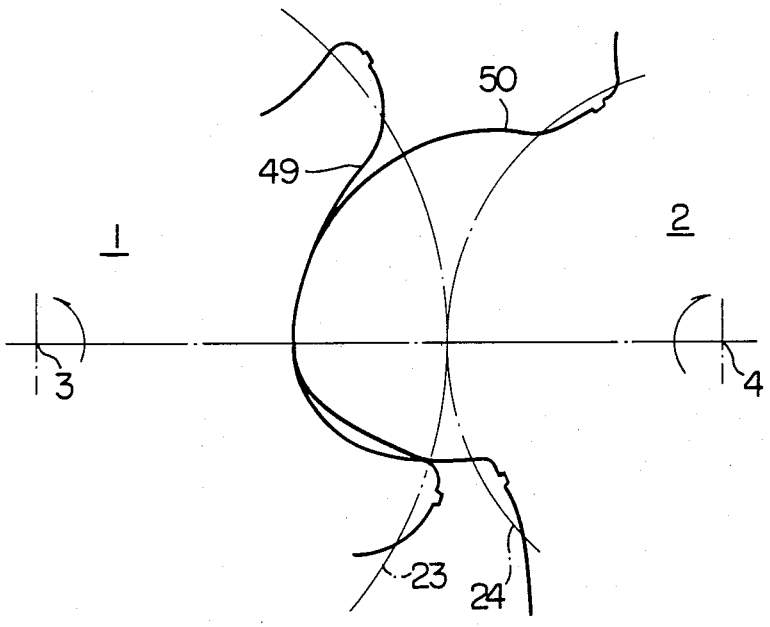
FIG. 5 is a detailed view in explanation of the basic tooth forms of the screw rotors according to the invention.

FIG. 5 illustrates the basic rotor tooth forms 49, 50 of the female rotor 1 and male rotor 2 in meshing engagement with each other without any clearance therebetween in normal temperature condition. The normal temperature condition is the temperature at which the rotors are fabricated (about 20° C.).

Figure 6:
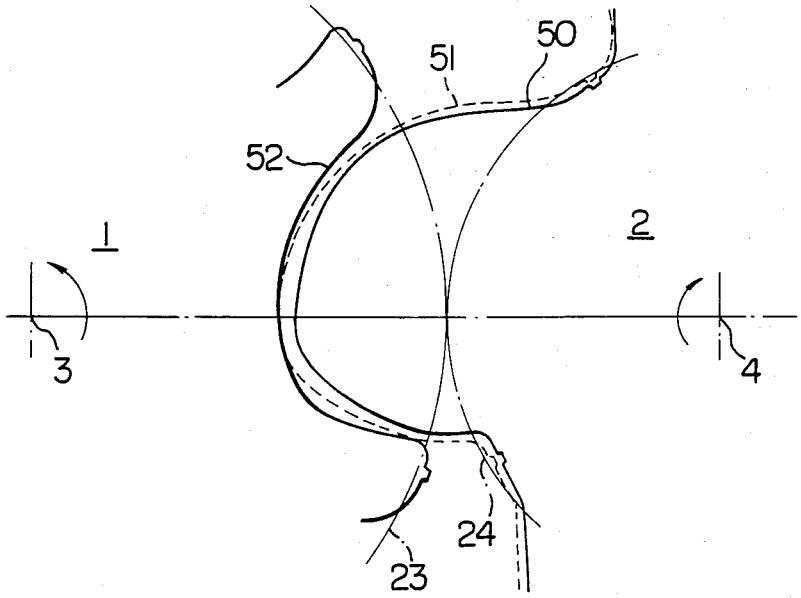
FIGS. 6–9 are detail views showing a first embodiment of the screw rotors in accordance with the invention in which thermal expansion is taken into consideration for obtaining the tooth forms for the screw rotors.
Figure 7:
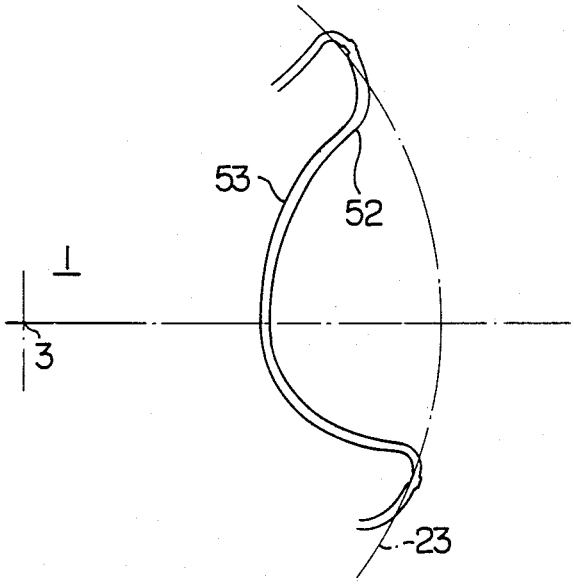
Figure 8:
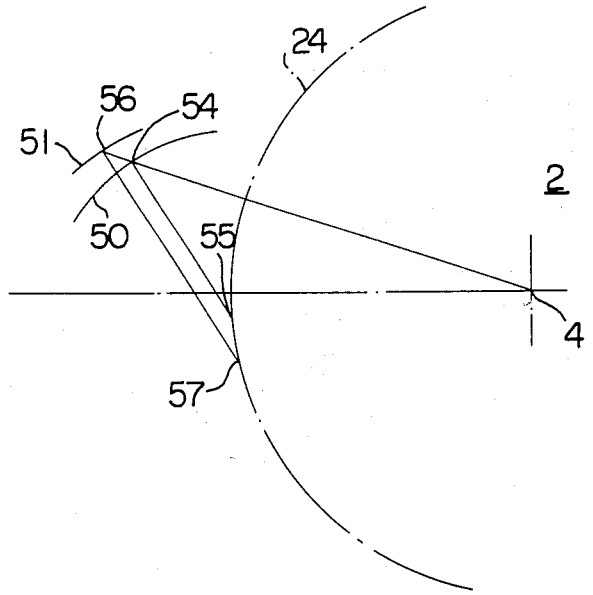

FIGS. 6–8 show the process for working the invention and, in the illustrated embodiment, the male rotor 2 is used as a reference and the imparting of the basic tooth form 50 to the male rotor 2 is accomplished in the following manner.

In FIGS. 6 and 7, a rotor tooth form 51 is obtained by thermal deformation of the basic tooth form 50 of the male rotor 2 during operation of the rotors 1, 2. The rotor tooth form 51 obtained by deformation caused by thermal expansion can be obtained by calculation by a process of finite elements or the like based on a temperature distribution obtained by measuring the temperature in the male rotor 2. A rotor tooth form 52 of the female rotor is generated by the rotor tooth form 51 of the male rotor 2.

By returning the rotor form 52 to a normal temperature condition, a rotor tooth form 53 of the female rotor 1 in normal temperature condition can be obtained. At this time, one has only to obtain the rotor tooth form 53 by the process of finite elements or the like based on a temperature distribution in the female rotor 1 as described hereinabove.

Assume that a temperature in a cross section or the two rotors 1, 2, perpendicular to the axis under operation, is constant, and that thermal expansion of the rotors due to a rise in temperature occurs such that the rotors 1, 2 expand in a radial direction corresponding to the distance from the center of each rotor to an arbitrarily selected point on the rotor tooth form.

In FIG. 8, a normal to an arbitrarily selected point 54 on the basic tooth form 50 of the male rotor 2 is 54–55. The point 54 shifts to a point 56 as a result of expansion in the radial direction due to a rise in temperature. At this time, a normal 56–57 to the point 56 moves parallel to the line 54–55, so that the point 56 exists on the rotor tooth form 51 obtained by thermal deformation of the basic tooth form 50 of the male rotor 2.

Calculation is done in like manner on thermal deformation at various points on the basic tooth form 50 to obtain the rotor tooth form 51.

Figure 9:
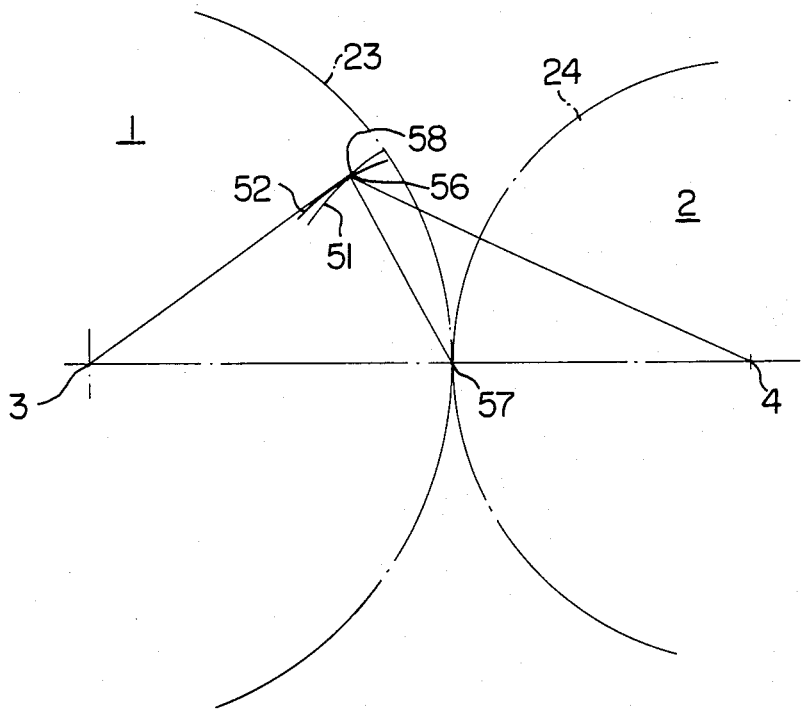

Then the rotor tooth form 52 of the female rotor 1 generated by the rotor tooth form 51 of the male rotor 2 obtained by deformation of the basic tooth form 50 is obtained as follows. As shown in FIG. 9, when the point 57 is located on an intersection of the pitch circles a point 58 on a rotor tooth form generated by the rotor tooth form at the point 56 can be obtained. The point 58 exists on the rotor tooth form 52.

To change the rotor tooth form 52 back to the rotor tooth form 53, it is only necessary to reverse, the steps of the process described hereinabove by referring to conversion of the rotor tooth form 50 to the rotor tooth form 51.

In the present invention, one rotor tooth form produced by taking thermal expansion into consideration is used for generating the other tooth form, so that it is possible to maintain a minimum clearance through the entire region of the tooth forms of the female and male rotors 1 and 2 during operation. This is conducive to markedly improving the operational performance of the screw rotors of the dry type screw compressors.

Figure 10:
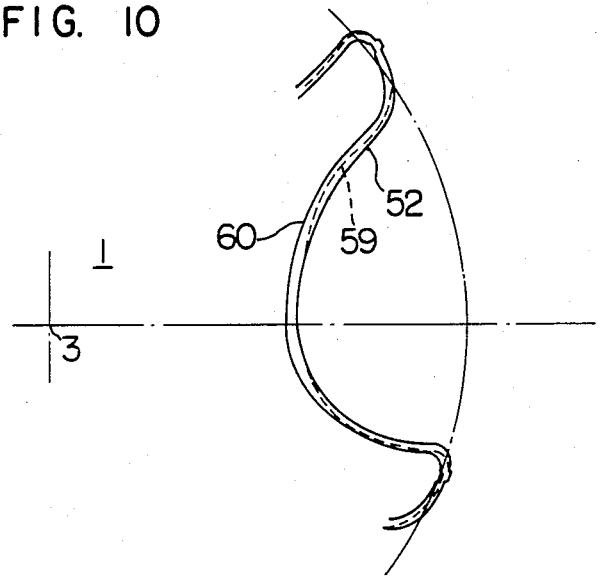
FIGS. 10 and 11 are detail views showing a second embodiment of the screw rotors in accordance with the invention in which thermal expansion is taken into consideration for obtaining the tooth forms for the screw rotors.

In FIG. 10, transmission of rotation between the female and male rotors 1 and 2 is effected through synchronizing means, such as synchronizing gears, not shown, located outside the working chambers of the rotors 1 and 2. As the example shown in FIG. 9, this example shown in FIG. 10 also uses the male rotor 2 as a reference and imparts the basic tooth form to the male rotor 2.

A rotor tooth form 59 is obtained from the rotor tooth form 52 of the female rotor 1 by reducing the backlash of the synchronizing gears and the minimum clearance necessary for avoiding contacting between the rotors 1 and 2 while they are meshing with each other. A rotor tooth form 60 is obtained by returning the rotor tooth form 59 to a normal temperature condition that can be obtained as by the process of finite elements based on a temperature distribution in the female rotor 1 as described hereinabove.

Figure 11:
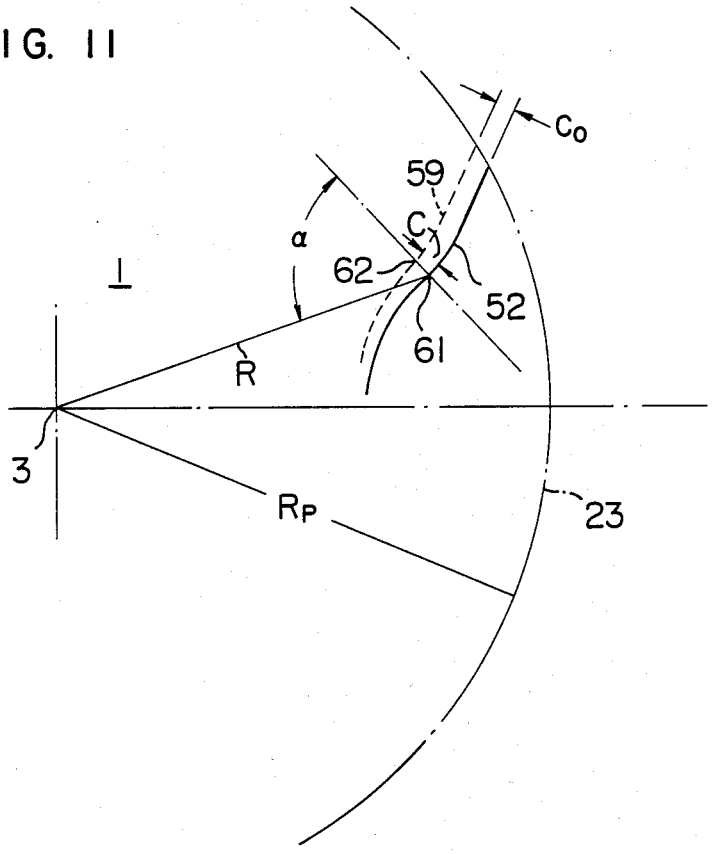

To obtain the rotor tooth form 59, as shown in FIG. 11 assuming the sum of the backlash of the synchronizing gear on the pitch circle 23 of the female rotor 1 and the necessary minimum clearance between the rotors 1 and 2, a length 3–61 of the radius vector at an arbitrarily selected point 61 of the rotor tooth form 52 deformed by thermal expansion, the angle formed by the radius vector and the normal to the tooth form at the point 61 and the radius from the center point 3 to the pitch circle 23 are respectively denoted by $C_o$, R, $\alpha$ and $R_p$, when backlash is taken into consideration, the point 61, arbitrarily selected on the rotor tooth form 52, shifts to a point 62. The distance C between the two points 61 and 62 can be expressed by the following equation:

$$C=(R/R_p)\cdot C_o\cdot\sin\alpha.$$

By this equation, the rotor tooth form 59, taking the backlash into consideration can be obtained from the rotor tooth form 52 deformed by thermal expansion.

The rotor tooth form 59 can be converted to the rotor tooth form 60 by reversing the steps of the process described hereinabove with reference to conversion of the rotor tooth form 50 to the rotor tooth form 51.

The reason why the backlash is taken into consideration is because greater effects can be achieved by taking into consideration the backlash of the synchronizing gears in obtaining optimum meshing of the rotors during operation, when such gears are used as synchronizing means.

In the invention, the backlash of the synchronizing gears is taken into consideration when the female and male rotors 1, 2 are deformed by thermal expansion during operation, so that it is possible to keep the two rotors 1, 2 from coming into contact with each other during operation. This is conducive to improving the reliability of the screw compressor. It is possible, of course, to improve the performance of the screw compressor by imparting to the rotors 1, 2 a minimum amount of backlash in an allowable range of values.

Figure 12:
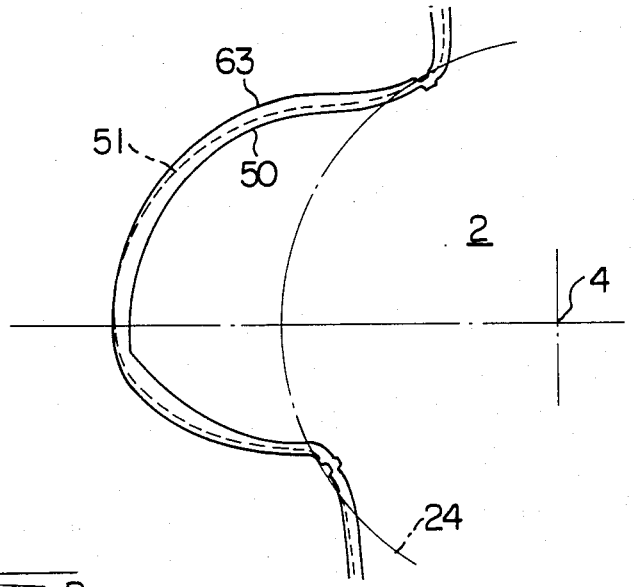
FIGS. 12 and 13 are detail views showing a third embodiment of the screw rotors in accordance with the invention in which thermal expansion is taken into consideration for obtaining the tooth forms for the screw rotors.
Figure 13:
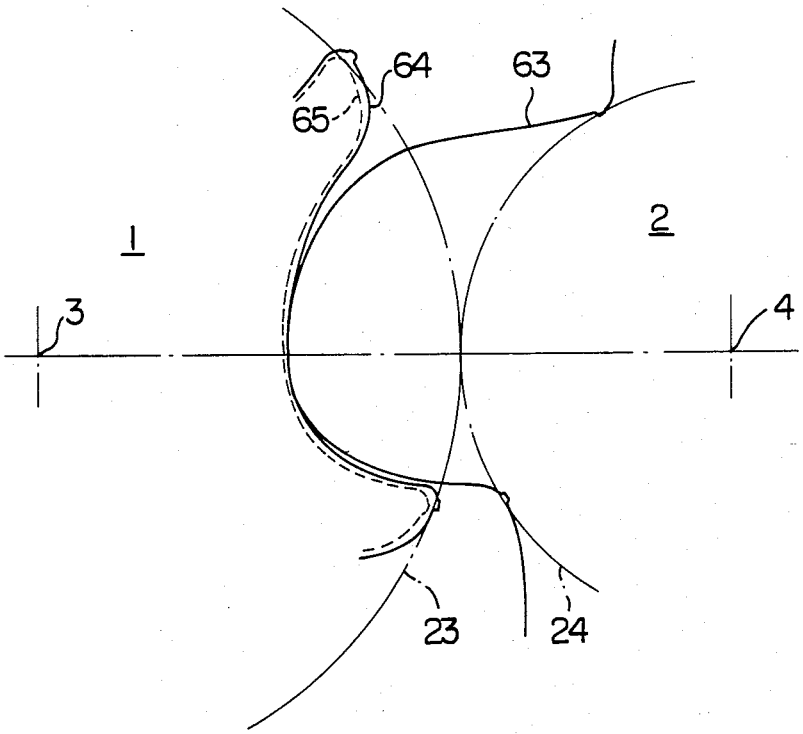

In FIGS. 12 and 13 a rotor tooth form 63 is provided which takes the backlash into consideration, with the rotor tooth form 63 representing the rotor tooth form 51 obtained by deformation due to thermal expansion of the basic tooth form 50 plus the backlash of the synchronizing gears and the necessary minimum clearance between the rotors for avoiding contacting of the rotors while rotating in meshing engagement. A rotor tooth form 64 of the female rotor 1 is generated by the rotor tooth form 63 that is defined taking into consideration the thermal expansion of the male rotor 2 and the backlash of the synchronizing gears, and a rotor tooth form 65 of the female rotor 1 is obtained by returning the rotor tooth form 64 to a normal temperature condition.

By forming the female rotor 1 and the male rotor 2 as described hereinabove, various advantages can be offered because the clearance between the two rotors 1, 2 is minimized due to their being free from the backlash of the synchronizing gears and to a minimum clearance being maintained between them to avoid direct contact therebetween. It is thus possible, to minimize leaks of the gas, thereby enabling the efficiency of the screw compressor to be greatly improved.

The clearance between the rotors 1, 2 and the casing can be effectively reduced due to the fact that thermal deformation of the rotors 1, 2 can be determined accurately.

Figure 14:
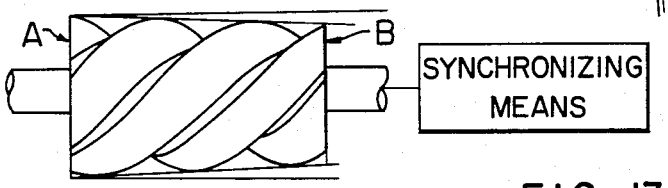
FIG. 14 is a side view of a screw rotor representing a modification of the embodiments of the invention.

In the first, second and third embodiments of the invention described hereinabove, the temperature distribution in the axial direction of the rotors 1, 2 under operation is considered constant. However, in actual operating conditions, a temperature gradient of a substantial degree may exist in the axial direction of the rotors 1, 2 depending on the operating conditions including the conditions of the working fluid, pressure, etc. When the temperature distribution on the suction side of low temperature and the temperature distribution on the discharge side of high temperature are taken into consideration, the rotor tooth form is given with a shape which tapers or its outer periphery converges in going from the suction side (indicated by A) at one end of the rotor toward the discharge side (indicated by B) at the other end thereof, as shown in FIG. 14. As can readily be appreciated, the female rotor 1 or the male rotor 2 or both of them may be tapered as shown in FIG. 14.

The second and third embodiments of the invention have been described as being applied to rotors of a dry type screw compressors. However, it is to be understood, that such embodiments may have application in an oil-cooled type screw compressors as well.

From the foregoing description, it will be appreciated that in the screw rotors 1, 2 comprising a female rotor 1 and a male rotor 2 according to the invention, the tooth form of the female rotor includes a flank of the surface of advance constituted by an arc and a second order curve, and a flank of the surface of retrocession constituted by a curve generated by an arc located at a forward end portion of a robe of the male rotor and an arc, and the tooth form of the male rotor is essentially produced by generating the loci of the flank of the surface of advance of the female rotor and the flank of the surface of retrocession thereof. This enables a minimum clearance to be maintained through the entire region between the tooth forms of the female and male rotors 1, 2 meshing with each other, thereby greatly improving the performance and reliability of the screw compressors.

Additional advantages of the present invention reside in the fact that the service life of the tools for processing the screw rotors 1, 2 can be prolonged and the area of the blowholes can be minimized.

What is claimed is:

1. Rotor tooth forms for a screw rotor of a rotor machine comprising a female rotor and a male rotor rotating about two axes parallel to each other, said female rotor having a rotor tooth form including a flank of a surface of advance comprising a first flank of the surface of advance formed by a second order curve, and a second flank of the surface of advance formed by an arc of a radius $R_1$ having a center thereof inside a pitch circle of the female rotor, and a flank of a surface of retrocession comprising a first flank of the surface of retrocession generated by a forward end portion of a lobe on the male rotor formed by an arc of a radius $R_4$ having a center thereof on a line drawn from a pitch point at an angle $\phi$ with respect to a straight line connecting the two axes together, and a second flank of the surface of retrocession formed by a circular arc of a radius $R_3$ smaller than the radius $R_1$ having a center thereof inside the pitch circle of the female rotor, the rotor tooth form of the male rotor being essentially formed by generating loci of the flank of the surface of advance of the female rotor and the flank of the surface of retrocession thereof.

2. Rotor tooth forms as claimed in claim 1, wherein said rotor tooth form of the male rotor is determined in dependence upon a thermal expansion of both the male and female rotors caused by an elevated temperature of the rotor machine during operation thereof.

3. A pair of screw rotors as claimed in claim 1, wherein said male and female rotors are formed at their outer peripheral portions with elevated portions serving as tooth top tips.

4. A pair of screw rotors as claimed in claim 1, wherein said second order curve forming said first flank of the surface of advance of said female rotor comprises a parabola focused inside the pitch circle of said female rotor.

5. A pair of screw rotors as claimed in claim 4, wherein said male and female rotors are formed at their outer peripheral portions with elevated portions serving as tooth top tips.

6. A pair of screw rotors as claimed in claim 1, wherein said second order curve constituting the first flank of the surface of advance of said female rotor comprises an arc of an imaginary circle having a center thereof outside the pitch circle of said female rotor.

7. A pair of screw rotors as claimed in claim 5, wherein said male and female rotors are formed at their outer peripheral portions with elevated portions serving as tooth top tips.

* * * * *